US006647591B1

(12) United States Patent
Domenig et al.

(10) Patent No.: US 6,647,591 B1
(45) Date of Patent: Nov. 18, 2003

(54) LOW PROFILE, PARTIAL DOOR OVERLAY HINGE

(75) Inventors: Georg Domenig, Kernersville, NC (US); Manfred Peer, Walkertown, NC (US)

(73) Assignee: Grass America Inc., Kernersville, NC (US)

( * ) Notice: Subject to any disclaimer, the term of this patent is extended or adjusted under 35 U.S.C. 154(b) by 0 days.

(21) Appl. No.: 10/186,803

(22) Filed: Jul. 1, 2002

(51) Int. Cl.[7] ..... E05D 7/04
(52) U.S. Cl. ..... 16/242; 16/238; 16/246
(58) Field of Search ..... 16/238, 242, 246, 16/235–237, 265, 382

(56) References Cited

U.S. PATENT DOCUMENTS

| | | | | |
|---|---|---|---|---|
| 4,506,409 A | | 3/1985 | Lautenschlager | |
| 4,620,343 A | * | 11/1986 | Grass | 16/236 |
| 4,716,622 A | | 1/1988 | DeBruyn | |
| 4,800,625 A | * | 1/1989 | Salice | 16/382 |
| 5,036,565 A | | 8/1991 | Salice | |
| 5,392,493 A | | 2/1995 | Youngdale | |
| 5,511,287 A | | 4/1996 | Lautenschlager et al. | |
| 5,577,296 A | * | 11/1996 | Grass | 16/258 |
| 5,577,297 A | * | 11/1996 | Lautenschlager et al. | 16/382 |
| 5,604,956 A | | 2/1997 | Grass | |
| 5,737,804 A | | 4/1998 | Ferrari et al. | |
| 5,819,371 A | * | 10/1998 | Rock et al. | 16/258 |
| 5,826,305 A | | 10/1998 | Domenig et al. | |
| 5,884,364 A | * | 3/1999 | Domenig et al. | 16/249 |
| 5,887,316 A | | 3/1999 | Ferrari et al. | |
| 5,920,958 A | | 7/1999 | Domenig et al. | |
| 5,930,866 A | | 8/1999 | Rupprechter | |
| 6,049,946 A | | 4/2000 | Cress et al. | |
| 6,125,508 A | | 10/2000 | Formenti | |
| 6,145,164 A | * | 11/2000 | Ferrari et al. | 16/242 |
| 6,167,590 B1 | | 1/2001 | Domenig | |
| 6,170,121 B1 | | 1/2001 | Domenig | |
| 6,240,599 B1 | | 6/2001 | Peer et al. | |
| 6,289,556 B1 | * | 9/2001 | Salice | 16/335 |
| 6,442,798 B1 | * | 9/2002 | Rupprechter | 16/242 |
| 6,463,626 B1 | * | 10/2002 | Ferrari et al. | 16/236 |
| 6,470,531 B2 | | 10/2002 | Domenig et al. | |

FOREIGN PATENT DOCUMENTS

| | | | |
|---|---|---|---|
| JP | 2000-104446 | * | 4/2000 |
| WO | WO 01/84261 A1 | * | 11/2001 |

* cited by examiner

*Primary Examiner*—Chuck Y. Mah
(74) *Attorney, Agent, or Firm*—John M. Harrington; Kilpatrick Stockton LLP

(57) ABSTRACT

This invention relates to hinges for mounting a door on a furniture article frame. The hinges include at least a hinge cup member adapted to be affixed to the furniture door and a top hinge arm segment pivotably connected to the hinge cup member and having a top center hole and a top elongated aperture with one end open to the top center hole. Various intermediate hinge arm segments and base hinge arm segments can be used with the top hinge arm segment to allow adjustments to be made in two or three directions. In some embodiments, turning an adjustment screw allows adjustments to be made horizontally from side-to-side so that the desired spacing of the door from opposite sides of the door opening can be set. In some embodiments, turning a cam screw allows adjustments to be made horizontally in-and-out so that the desired alignment of the door with the front face of the furniture article frame can be set. In some embodiments, vertical adjustments can also be made, either by loosening a fastening screw or by turning a cam screw, so that the desired spacing from the top and bottom of the door opening can be set.

32 Claims, 12 Drawing Sheets

LOW PROFILE, PARTIAL DOOR OVERLAY HINGE

FIELD OF THE INVENTION

The present invention relates generally to hinge devices for mounting a door on a furniture article, and more particularly to adjustable hinge devices for hanging doors on cabinets or the like so that the doors can be adjusted relative to the supporting frame they are attached to.

BACKGROUND OF THE INVENTION

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Accordingly, many adjustable hinges may require more than one person to accomplish the adjustment. Examples of such hinges include those described in U.S. Pat. Nos. 5,295,282, 5,392,493, and 5,511,287. Improvements to these hinges have been made, such as those depicted in U.S. Pat. No. 6,240,599, so that adjustments can be made quickly and easily by one person. However, further improvements are still needed so that hinges can be adjusted with greater efficiency and more precise reliability. To do this, it has been determined that more refined design engineering is required, and the present invention addresses this need and interest.

SUMMARY OF THE INVENTION

Accordingly, the above-identified shortcomings of existing adjustable hinges are overcome by embodiments of the present invention. The general purpose of the present invention, which will be described subsequently in greater detail, is to provide new and improved adjustable hinges for mounting a door on a frame of a furniture article such as a cabinet or desk, that is easily adjustable for adjusting the door relative to the supporting frame, and that has all of the advantages of prior art hinges and none of the disadvantages. The present invention provides a hinge that is microadjustable, or continuously adjustable in a precise manner, throughout the range of adjustment provided. Further, the present invention provides a hinge that enables stable microadjustments by actuating a single adjustment screw for each directional adjustment. The components of the hinge remain stably secured to each other, and to the door and the frame of the furniture article throughout the adjustment. Adjustment may be accomplished by a single person without the door becoming unsecured or unstable relative to the frame of the furniture article.

Some representative embodiments of the present invention are illustrated in the drawings. Some embodiments of the hinges of the present invention make use of a first hinge member in the form of a cup mountable flush in a bore hole with fastening screws in a known way in the back of a door, and a second hinge member adapted to be affixed to a frame. The second hinge member is in the form of a hinge arm that includes a substantially flat base portion/segment preferably having an opening in the form of an elongated slot through which a fastening screw can be driven into the frame in a known way, thereby allowing adjustments to be made in an up-and-down or vertical direction. The second hinge member of the present invention may also include adjustment mechanisms on the hinge arm for allowing adjustments to be made in a second and/or third direction. One adjustment mechanism may allow adjustments to be made in an in-and-out, forward-and-back, or horizontal direction. Another adjustment mechanism may allow adjustments to be made in another horizontal direction (i.e., in an arcing or curved horizontal plane) so that side-to-side adjustments of the door can be made.

Other embodiments of the hinges of the present invention make use of a first hinge member in the form of a cup mountable flush in a bore hole with fastening screws in a known way in the back of a door, and a second hinge member adapted to be affixed to a frame. This second hinge member is in the form of a hinge arm that includes a substantially flat, fixedly-attached base portion/segment through which at least one fastening screw can be driven into the frame in a known way. As the base portion of this hinge is fixed, vertical adjustments are made via other portions of the second hinge member.

In a preferred embodiment, the present invention relates to a three-dimensionally adjustable hinge for mounting a door on a frame of a furniture article. This hinge has a three piece hinge arm construction and comprises a hinge cup member adapted to be affixed to a furniture door; a top hinge arm segment pivotably connected at its arm end to the hinge cup member and having a center hole and an elongated aperture with one end open to the center hole; a base hinge arm segment pivotably connected to the top hinge arm segment and having an elongated center hole and a circular aperture; and an intermediate hinge arm segment having a center hole, a circular aperture and an elongated aperture, wherein the base hinge arm segment is slideably connected to the intermediate hinge arm segment with a cam screw or an eccentric screw via the elongated aperture in the intermediate hinge arm segment and the circular aperture in the base hinge arm segment, the intermediate hinge arm segment is pivotably in communication with the top hinge arm segment, and the intermediate hinge arm segment is adjustably connected to the top hinge arm segment by an adjustment screw cooperating with the open-ended elongated aperture in the top hinge arm segment and the circular aperture in the intermediate hinge arm segment. Turning this adjustment screw causes the intermediate hinge arm segment, and therefore the base hinge arm segment since they are connected together, to move relative to the top hinge arm segment in a horizontally arcing direction, thereby allowing side-to-side adjustments to be made to the door. Turning this cam screw or the eccentric screw causes the base hinge arm segment to move relative to the intermediate hinge arm segment in a horizontal direction in and out (if the hinge is in its closed position). The elongated center hole in the base hinge arm segment allows vertical up-and-down adjustments to be made to the door (if the hinge is in its closed position).

In another embodiment, the present invention relates to a two-dimensionally adjustable hinge for mounting a door on a frame of a furniture article, comprising a hinge cup member adapted to be affixed to a furniture door; a top hinge arm segment pivotably connected at its arm end to the hinge cup member and having a center hole and an elongated aperture with one end open to the center hole; a base hinge arm segment being pivotably connected to the top hinge arm segment and having an elongated center hole and a circular aperture, wherein the top hinge arm segment and the base hinge arm segment are adjustably connected to one another by an adjustment screw cooperating with the elongated aperture in the top hinge arm segment and the circular aperture in the base hinge arm segment. Turning this adjustment screw causes the base hinge arm segment to move relative to the top hinge arm segment in a horizontally arcing direction (if the hinge is in its closed position), thereby allowing side-to-side adjustments to be made to the door. The elongated center hole in the base hinge arm segment allows vertical up-and-down adjustments to be made to the door (if the hinge is in its closed position). Since this two-dimensionally adjustable hinge has no intermediate hinge arm segment and no cam screw or eccentric screw, it is less expensive to manufacture than the three-dimensionally adjustable hinge. However, no front-to-back adjustments can be made with this embodiment.

In yet another embodiment, the present invention relates to another three-dimensionally adjustable hinge for mounting a door on a frame of a furniture article. This hinge has a four piece hinge arm construction and comprises a hinge cup member adapted to be affixed to a furniture door; a top hinge arm segment pivotably connected at its arm end to the hinge cup member and having a center hole and an elongated aperture with one end open to the center hole; a base hinge arm segment fixedly-connected to a furniture frame and having three elongated slots and a circular aperture; a top intermediate hinge arm segment having a center hole, a circular aperture and an elongated aperture; and a bottom intermediate hinge arm segment having an elongated center hole, two circular holes and a pair of bent projections, wherein the bottom intermediate hinge arm segment is slideably connected to the base hinge arm segment via the pair of bent projections on the bottom intermediate hinge arm segment that are designed to be received into two of the three elongated slots in the base hinge arm segment, wherein the bottom intermediate hinge arm segment is further slideably connected to the base hinge arm segment with a center cam screw or an eccentric screw via the elongated center hole in the bottom intermediate hinge arm segment and the circular aperture in the base hinge arm segment, wherein the bottom intermediate hinge arm segment is pivotably connected to the top hinge arm segment, wherein the top intermediate hinge arm segment is pivotably in communication with the top hinge arm segment, wherein the top intermediate hinge arm segment is adjustably connected to the top hinge arm segment by an adjustment screw cooperating with the open-ended elongated aperture in the top hinge arm segment and the circular aperture in the top intermediate hinge arm segment, and wherein the top intermediate hinge arm segment is slideably connected to the bottom intermediate hinge arm segment with a second cam or eccentric screw via the elongated aperture in the top intermediate hinge arm segment and one of the circular apertures in the bottom intermediate hinge arm segment. In this embodiment, the bottom intermediate hinge arm segment may also have a projection on its bottom side that is received into the third elongated slot in the base hinge arm segment. This projection may be in the form of a rivet that has a flanged distal end, and the third elongated slot in the base hinge arm segment may be beveled to accommodate the flanged distal end of the rivet that it receives. Turning this center cam or eccentric screw causes the bottom intermediate hinge arm segment to move relative to the base hinge arm segment in a vertical up-and-down direction (if the hinge is in its closed position). Turning this second cam or eccentric screw causes the top intermediate hinge arm segment to move relative to the bottom intermediate hinge arm segment in a horizontal in-and-out direction (if the hinge is in its closed position). Turning this adjustment screw causes the top intermediate hinge arm segment, and therefore the bottom intermediate hinge arm segment, to move relative to the top hinge arm segment in a horizontally arcing direction (if the hinge is in its closed position).

In preferred embodiments, the adjustment screw of this invention further comprises an unthreaded portion proximate the head of the adjustment screw, and the unthreaded portion engages an unthreaded circular aperture in one of the hinge arm segments. For example, in the first three-dimensionally adjustable hinge discussed above, the threads of the adjustment screw engage the open-ended elongated slot in the top hinge arm segment and the unthreaded portion of the adjustment screw engages the circular aperture in the intermediate hinge arm segment. In the two-dimensionally adjustable hinge discussed above, the threads of the adjustment screw engage the open-ended elongated slot in the top hinge arm segment and the unthreaded portion of the adjustment screw engages the circular aperture in the base hinge arm segment. In the second of the three-dimensionally adjustable hinges discussed above, the threads of the adjustment screw engage the open-ended elongated slot in the top hinge arm segment and the unthreaded portion of the adjustment screw engages the circular aperture in the top intermediate hinge arm segment.

In another preferred embodiment, the open-ended elongated aperture in the top hinge arm segment has no threads, thereby saving the secondary operation of threading that opening. Instead of threading the elongated opening, one side of the opening may be displaced horizontally in front of the other side so as to receive and match the pitch of the adjustment screw threads. The horizontal displacement between the sides of the elongated opening are preferably slightly greater than the horizontal distance between the valleys on the opposite sides of the screw thread, thereby creating tension to hold the adjustment screw in position. The elongated aperture in the top hinge arm segment is purposely made open to the center hole so as to facilitate easy assembly. Furthermore, the elongated aperture in the top hinge arm segment is purposely elongated to allow the hinge arm to pivot in an arc as the adjustment screw is turned.

In another preferred embodiment, at least one of the hinge arm segments further comprises opposing lateral edges from which depend a pair of opposing side members that define a channel for receiving another hinge arm segment. More preferably, the opposing lateral edges are spaced from one another a distance that defines a width of the hinge arm segment. Most preferably, the opposing side members are spaced from one another a distance that is at least as great as the width of another hinge arm segment. For example, in the first three-dimensionally adjustable hinge discussed above, the top hinge arm segment and the base hinge arm segment may both have opposing side members that define the width of the respective segments, with the width of the base hinge arm segment being slightly less than the width of the top hinge arm segment so that the opposing side members of the base hinge arm segment nest within the opposing side members of the top hinge arm segment. Alternatively, all three of these hinge arm segments could have opposing side members defining the width of each respective segment, with the widths of the segments varying so that the opposing side members of all three hinge arm segments nest together one within another. In the two-dimensionally adjustable hinge, the top hinge arm segment and the base hinge arm segment may both have opposing side members that define the width of the respective segments, with the width of the base hinge arm segment being slightly less than the width of the top hinge arm segment so that the opposing side members of the base hinge arm segment nest within the opposing side members of the top hinge arm segment. In the second three-dimensionally adjustable hinge discussed above, the top hinge arm segment and the bottom intermediate hinge arm segment may both have opposing side members that define the width of the respective segments, with the width of the bottom intermediate hinge arm segment being slightly less than the width of the top hinge arm segment so that the opposing side members of the bottom intermediate hinge arm segment nest within the opposing side members of the top hinge arm segment. Alternatively, the bottom intermediate, the top intermediate and the top hinge arm segments of this hinge could all have opposing side members defining the width of each respective segment, with the widths of the segments varying so that the opposing side members of all three hinge arm segments nest together one within another.

In another preferred embodiment, a hinge arm segment may further comprise a raised portion that contacts and stabilizes the adjustment screw that is cooperating with the open-ended elongated slot in the top hinge arm segment and the circular aperture in another hinge arm segment. For example, in the first three-dimensionally adjustable hinge discussed above, the intermediate hinge arm segment may have a raised portion with a circular aperture for receiving the adjustment screw after it passes through the open-ended elongated slot in the top hinge arm segment. In the two-dimensionally adjustable hinge, the base hinge arm segment may have a raised portion with a circular aperture for receiving the adjustment screw after is passes through the open-ended elongated slot in the top hinge arm segment. In the second three-dimensionally adjustable hinge discussed above, the top intermediate hinge arm segment may have a raised portion with a circular aperture for receiving the adjustment screw after is passes through the open-ended elongated slot in the top hinge arm segment.

The three-dimensional adjustment aspect of some embodiments of the adjustable hinge of the present invention not only allows adjustment of the position of a cabinet door vertically up-and-down relative to the supporting cabinet (i.e., up and down with the door in the closed position to achieve desired spacing of the door from the top and bottom of the cabinet door opening) and horizontally in-and-out relative to the supporting cabinet (i.e., to and fro with the door in the closed position to achieve desired alignment of the front face of the door with the front of the cabinet), but also enables adjustment of the cabinet door horizontally from side-to-side relative to the supporting cabinet (i.e., from side to side with the door in the closed position to achieve desired spacing of the door from the opposite sides of the cabinet door opening).

Embodiments of the adjustable hinges of the present invention may also include, for example, a base hinge arm segment having an elongated center hole that extends parallel to the pivot axis of the hinge. The intermediate hinge arm segments preferably have a center hole that is somewhat rectangular and larger than the center hole of the base plate. The top hinge arm segment preferably has a center hole that is also somewhat rectangular and larger than the center hole of the base plate and at least as large as the center hole of any intermediate plate (if there are any). In embodiments, the base hinge arm segments are adapted to be fastened on the furniture article frame by at least one mounting screw inserted, preferably, through the elongated center hole of the base hinge arm segment. In embodiments, the elongated center hole in the base hinge arm segment is adapted to allow the base hinge arm segment to be displaced relative to the furniture article frame in a vertical direction (when the hinge is in its mounted and closed position) parallel to the pivot axis of the hinge by loosening the single mounting screw. In other embodiments, the base hinge arm segment may be fastened on the furniture article frame with two mounting screws, with neither mounting screw being secured through the center holes of any hinge arm segment.

The cam or eccentric screw is generally mounted in a hinge arm segment by means of a projection, and then extends through an elongated opening in another hinge arm segment to hold the two hinge arm segments together. The cam or eccentric screw is rotatable about a central axis thereof, and the projection extends parallel to the central axis of the cam or eccentric screw and is radially offset therefrom.

In the first three-dimensionally adjustable hinge discussed above, the cam or eccentric screw is mounted in the base hinge arm segment by means of a projection, and the cam or eccentric screw then extends through the elongated slot in the intermediate hinge arm segment. The elongated slot in the intermediate hinge arm segment extends parallel to the pivot axis of the hinge. Turning this cam or eccentric screw causes the base hinge arm segment to be displaced on the intermediate hinge arm segment in a direction perpendicular to the pivot axis of the hinge.

In the second three-dimensionally adjustable hinge discussed above, the center cam or eccentric screw is mounted in the base hinge arm segment by means of a projection, and the center cam or eccentric screw then extends through the elongated center hole in the bottom intermediate hinge arm segment. The elongated center hole in the bottom intermediate hinge arm segment extends perpendicular to the pivot axis of the hinge. The second cam or eccentric screw in this hinge embodiment is mounted in the bottom intermediate hinge arm segment by means of a projection, and the cam or eccentric screw then extends through the elongated hole in the top intermediate hinge arm segment. The elongated center hole in this top intermediate hinge arm segment extends parallel to the pivot axis of the hinge, as do the elongated apertures in this base hinge arm segment. Turning this center cam or eccentric screw causes the bottom intermediate hinge arm segment to be displaced on the base hinge arm segment in a direction parallel to the pivot axis of the hinge (i.e., up and down vertically). Turning this second cam or eccentric screw causes the top intermediate hinge arm segment to be displaced on the bottom intermediate hinge arm segment in a direction perpendicular to the pivot axis of the hinge (i.e., horizontally in and out).

The foregoing discussion focuses on the more important features of the invention so that the detailed description that follows may be better understood, and so that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be further understood that the phraseology and terminology employed herein are for the purpose of description and are not to be regarded as limiting. Those skilled in the art will appreciate that the conception on which this disclosure is based may readily be used as a basis for designing the structures and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved hinge for mounting a door on a frame of a furniture article such as a desk or cabinet which has all of the advantages, and more, of prior art devices and none of the disadvantages.

It is another object of the present invention to provide a new and improved hinge for mounting a door on a frame of a furniture article that is more reliable and functional than those presently available.

Yet another object of the present invention is to provide a new and sophisticated, precision-made adjustable hinge that is compact, that can operate reliably and efficiently, and yet enable renewed, limited adjustments to be made to the mounted door with respect to the frame of the furniture article It is an additional feature and advantage of the present invention to provide an adjustable hinge with a three-way adjustment aspect, which enables adjustment of the cabinet door horizontally in-and-out relative to the supporting cabinet (i.e., to and fro with the door in the closed position to achieve desired alignment of the front face of the door with the front of the cabinet), up-and-down (i.e., up and down with the door in the closed position to achieve desired spacing of the door from the top and bottom of the cabinet door opening), and side-to-side (i.e., from side to side with the door in the closed position to achieve desired spacing of the door from the opposite sides of the cabinet door opening).

These, together with other objects of the present invention, along with the various features of novelty which characterize the invention, are pointed out with particularity in the claims annexed to and forming a part of this document.

Embodiments of hinges according to the present invention include one or more unique aspects. Some embodiments of the present invention include many, if not all, of the above-mentioned aspects, but other embodiments may include less than all of the above-mentioned aspects.

Further objects, aspects and advantages of the present invention will be more readily apparent to those skilled in the art during the course of the following description, wherein references are made to the accompanying drawings which illustrate some preferred forms of the present invention and wherein like characters of reference designate like parts throughout the drawings.

DETAILED DESCRIPTION

For the purposes of promoting an understanding of the invention, reference will now be made to some preferred embodiments of the present invention as illustrated in FIGS. 1–12, and specific language used to describe the same. Numerous specific details are set forth below in order to provide a thorough understanding of the present invention. However, it will be obvious to one skilled in the art, that the present invention may be practiced without some or all of these specific details. Therefore, it should be understood that no limitation of the scope of the invention is hereby intended. The terminology used herein is for the purpose of description, not limitation. Any modifications or variations in the depicted hinges, and such further applications of the principles of the invention as illustrated herein, as would normally occur to one skilled in the art, are considered to be within the spirit of this invention.

Figure 1:
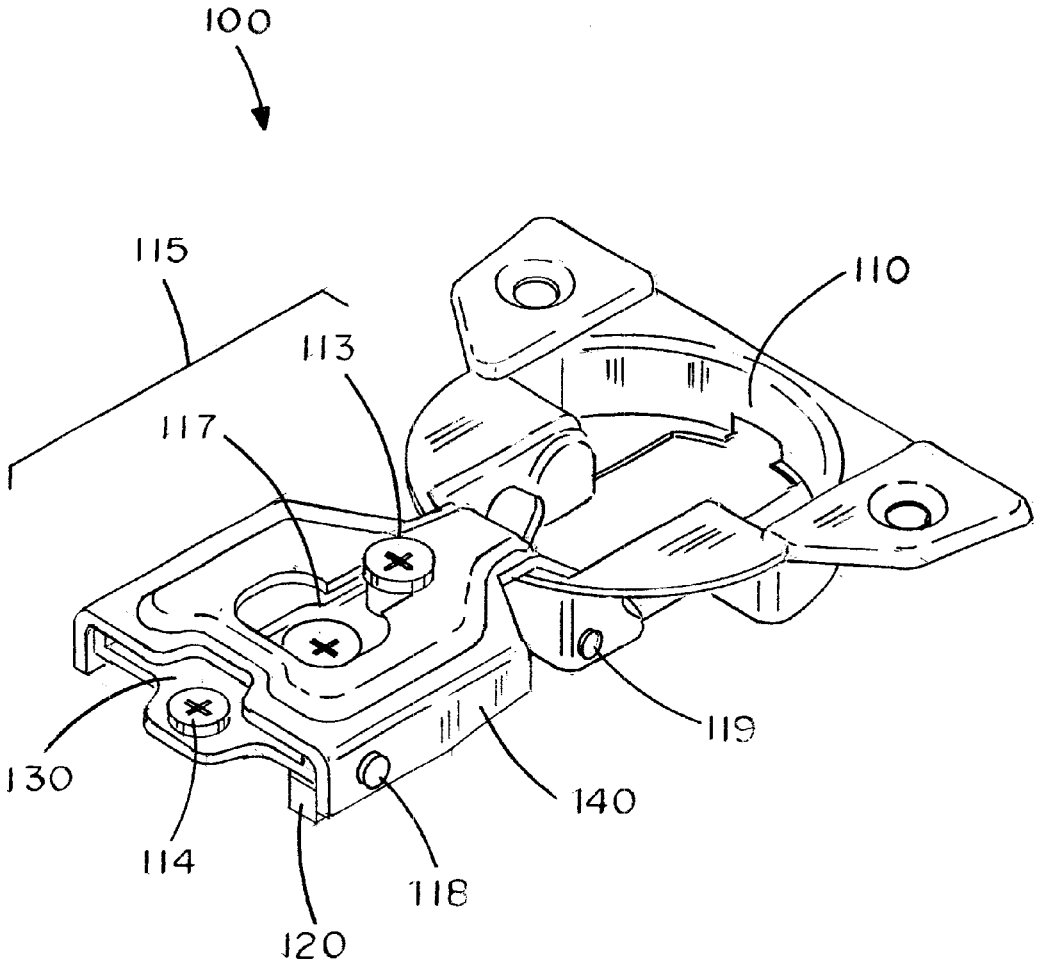
FIG. 1 is a top perspective view of one embodiment of a three-dimensionally adjustable hinge of the present invention having a three-piece hinge arm construction.
Figure 2:
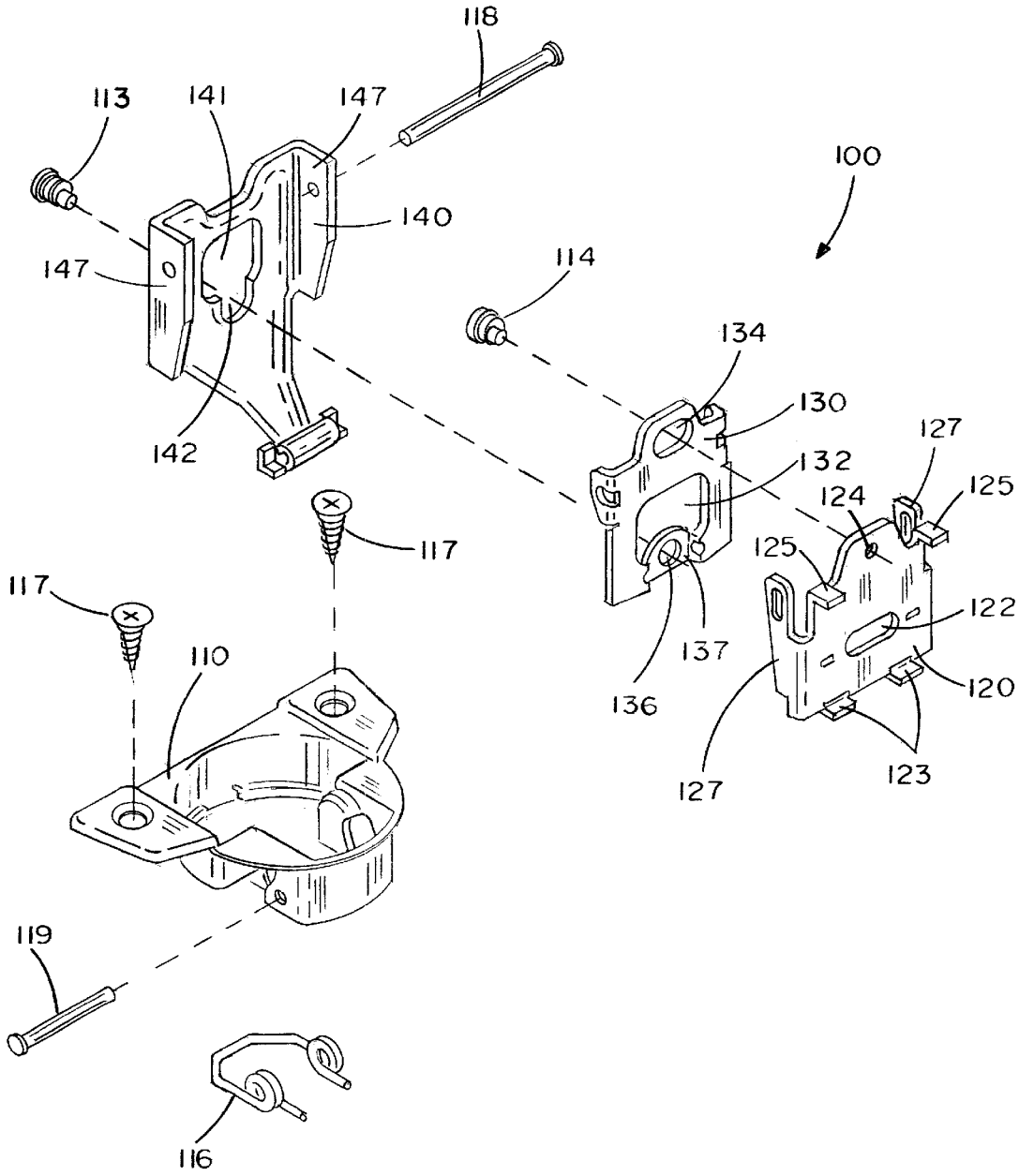
FIG. 2 is an exploded view of the adjustable hinge shown in FIG. 1.
Figure 3:
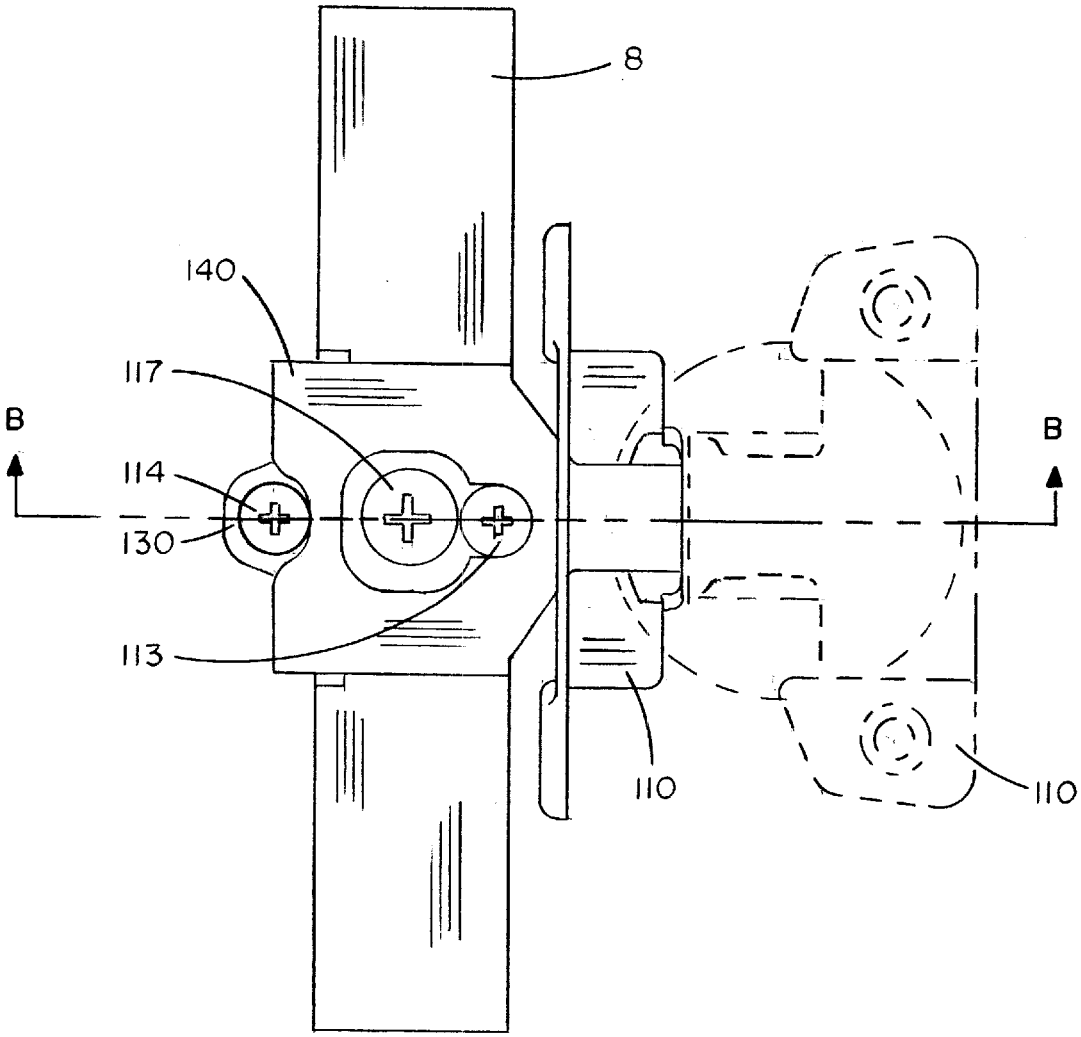
FIG. 3 is a top view of the adjustable hinge shown in FIGS. 1 and 2.
Figure 4:
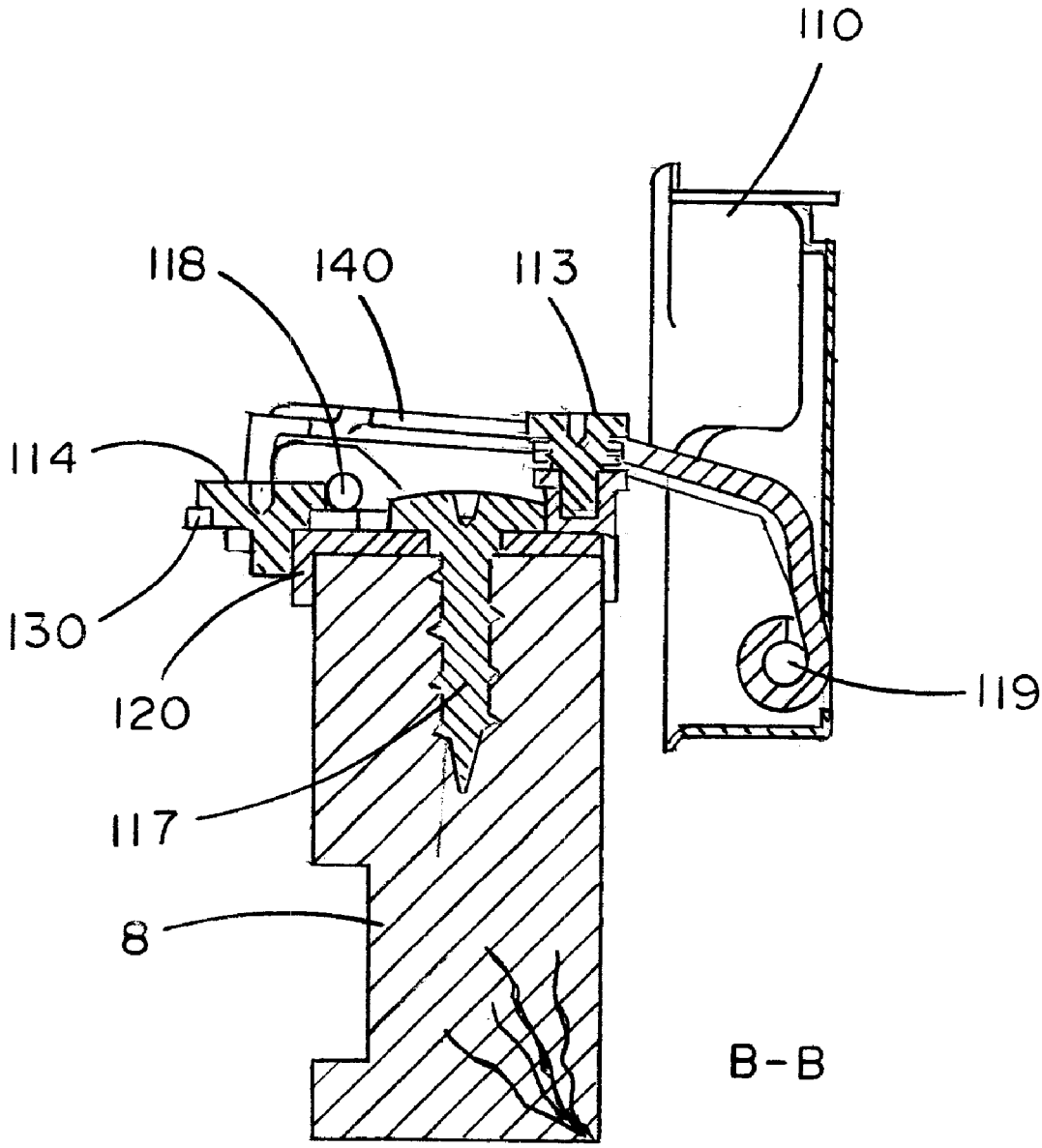
FIG. 4 is a side view of the adjustable hinge shown in FIGS. 1–3.

Referring now to FIGS. 1–4, there is shown various views of one embodiment of a three-dimensionally adjustable hinge 100 of the present invention having a three-piece hinge arm construction. These hinges may be used to hang a door on a frame 8 of a furniture article, such as a cabinet. FIG. 1 shows a top perspective view of hinge 100 in an open position (as it would appear when the cabinet door is open), and FIG. 4 shows a side view of hinge 100 in a closed position (as it would appear when the cabinet door is closed). The solid lines of FIG. 3 show a top view of hinge 100 in a closed position, and the dotted lines of FIG. 3 show a top view of hinge 100 in an open position. FIG. 2 shows an exploded view of hinge 100 so that all the individual parts of hinge 100 can be more readily seen and understood.

Hinge 100 comprises a hinge cup 110, a top hinge arm segment 140, an intermediate hinge arm segment 130 and a base hinge arm segment 120. Hinge cup 110 is mountable flush in a bore hole in the back of a door with fastening screws 117 in a known manner, and includes a spring 116 so as to facilitate automatic closing of a door once the hinge has been partially closed. Base hinge arm segment 120 is adapted to be affixed to a frame 8.

Top hinge arm segment 140 has a center hole 141 and an elongated aperture 142 with one end open to center hole 141. Intermediate hinge arm segment 130 has a center hole 132, an elongated aperture 134 and a circular aperture 136. Base hinge arm segment 120 has an elongated center hole 122 and a circular aperture 124.

Top hinge arm segment 140 has an arm end pivotably attached to hinge cup 110 on a pivot axis via hinge pin 119. Top hinge arm segment 140 is also pivotably attached to base hinge arm segment 120 on a pivot axis via hinge pin 118 fastened through top hinge arm segment 140 and base hinge arm segment 120, and sometimes also through intermediate hinge arm segment 130 as shown in FIG. 2. Base hinge arm segment 120 is slideably connected to intermediate hinge arm segment 130 with a cam or eccentric screw 114 via the elongated aperture 134 in the intermediate hinge arm segment 130 and the circular aperture 124 in the base hinge arm segment 120. Intermediate hinge arm segment 130 is also pivotably in communication with top hinge arm segment 140, in this case via hinge pin 118. Finally, top hinge arm segment 140 is adjustably connected to intermediate hinge arm segment 130 via adjustment screw 113. Adjustment screw 113 cooperates with the open-ended elongated aperture 142 in top hinge arm segment 140 and the circular aperture 136 in intermediate hinge arm segment 130 to allow horizontally arcing adjustments to be made (i.e., side to side adjustments).

Since intermediate hinge arm segment 130 is attached to both top hinge arm segment 140 (via adjustment screw 113) and base hinge arm segment 120 (via cam or eccentric screw 114), there is no necessity that hinge pin 118 pass through intermediate hinge arm segment 130. Instead, intermediate hinge arm segment 130 may be pivotably in communication with top hinge arm segment 140 via a rocking contact point between the two segments.

Three-dimensional adjustments can be made with hinge 100. First, the elongated center hole 122 in base hinge arm segment 120 accepts a fastening screw 117, thereby attaching the base hinge arm segment 120 of hinge arm portion 115 to frame 8 while also allowing vertical up and down adjustments to be made easily so that the desired spacing of the door from the top and bottom of the cabinet door opening can be adjusted. Second, when adjustment screw 113 is turned, intermediate hinge arm segment 130 moves relative to top hinge arm segment 140 in a horizontally arcing direction, thereby allowing side-to-side adjustments to be made so that the desired spacing of the doors from the opposite sides of the cabinet door openings can be adjusted. Third, when cam screw 114 is turned, base hinge arm segment 120 moves relative to intermediate hinge arm segment 130 in a horizontal in and out direction so that the desired alignment of the front face of the door with the front of the cabinet can be adjusted.

Figure 5:
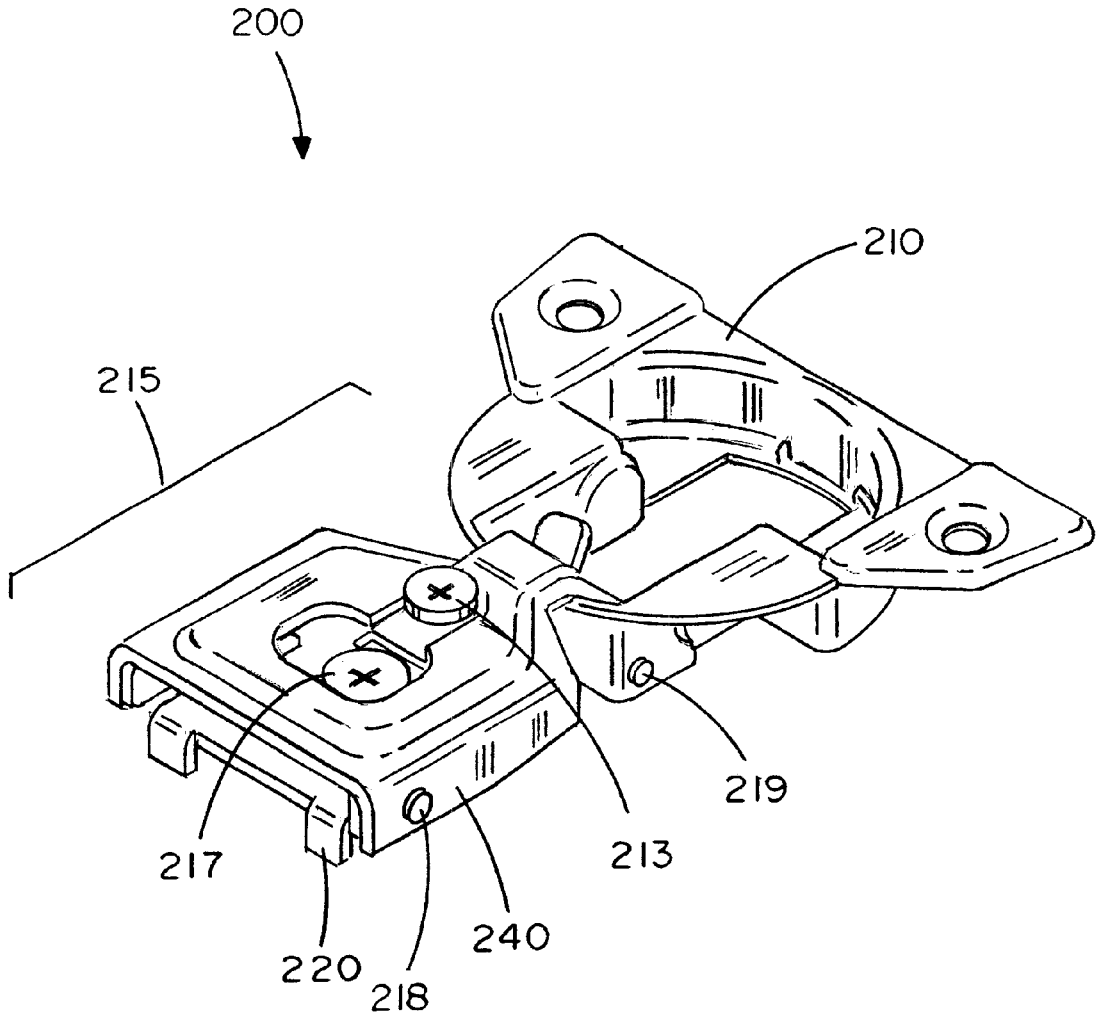
FIG. 5 is a top perspective view of one embodiment of a two-dimensionally adjustable hinge of the present invention having a two-piece hinge arm construction.
Figure 6:
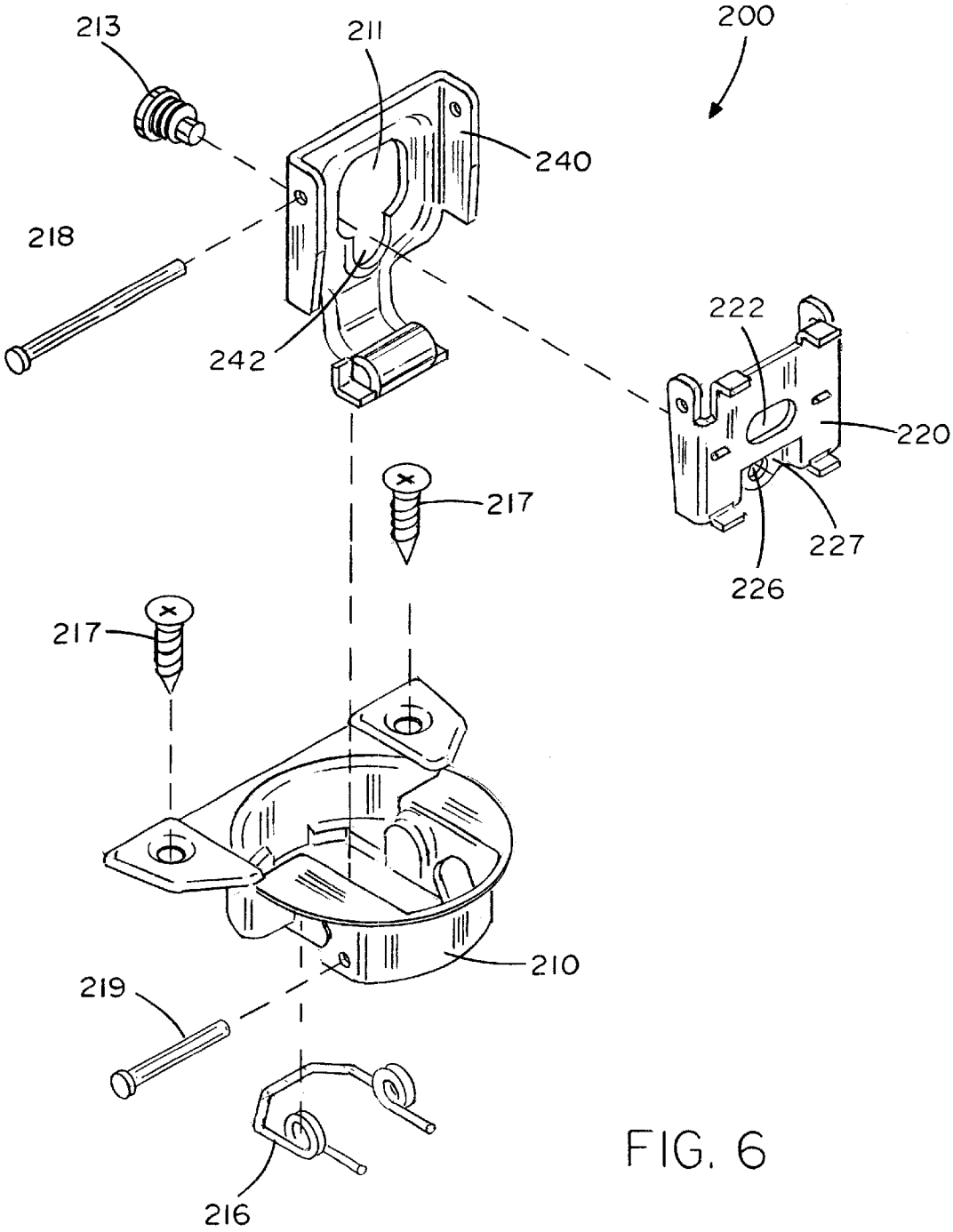
FIG. 6 is an exploded view of the adjustable hinge shown in FIG. 5.
Figure 7:
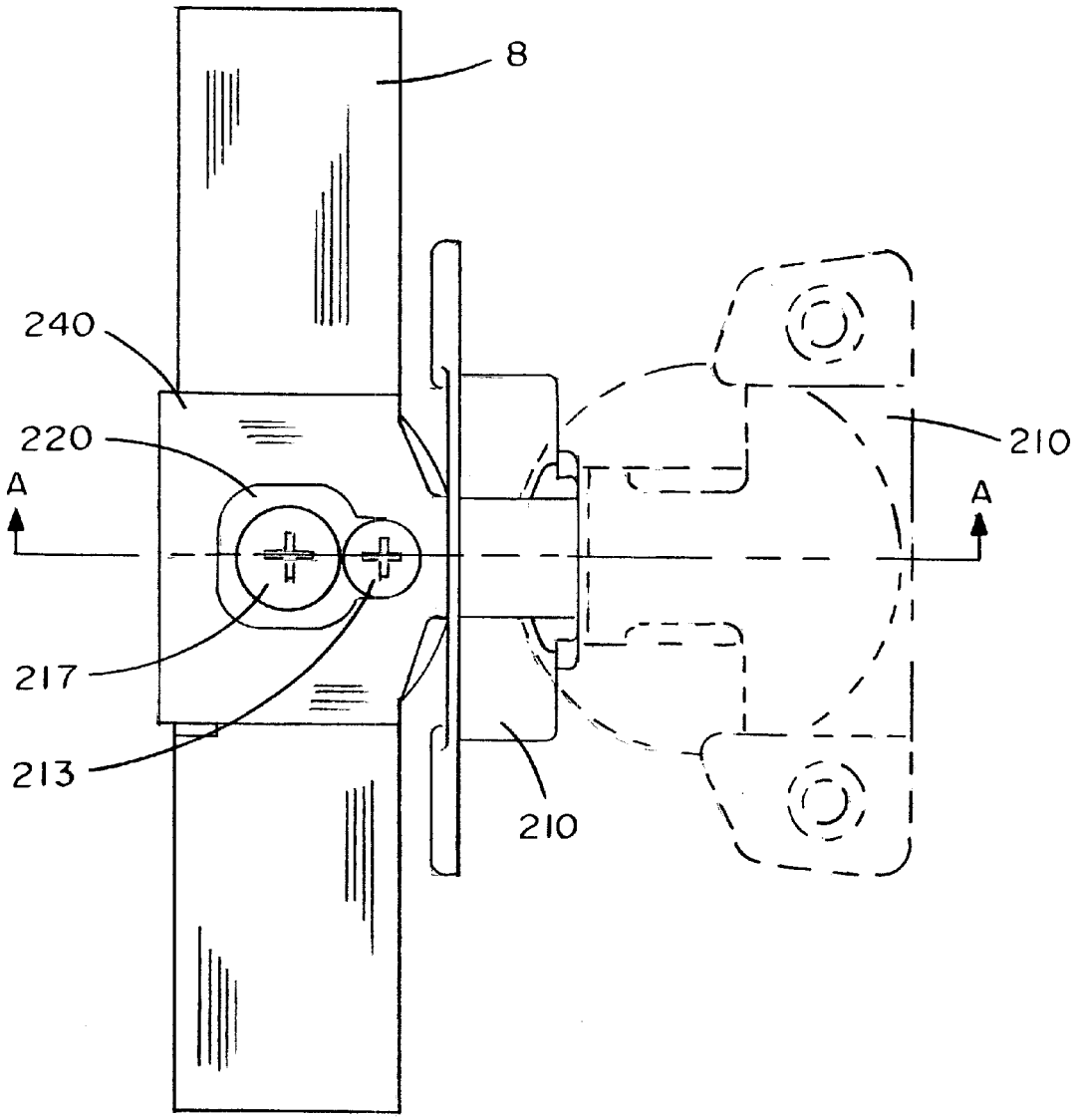
FIG. 7 is a top view of the adjustable hinge shown in FIGS. 5 and 6.
Figure 8:
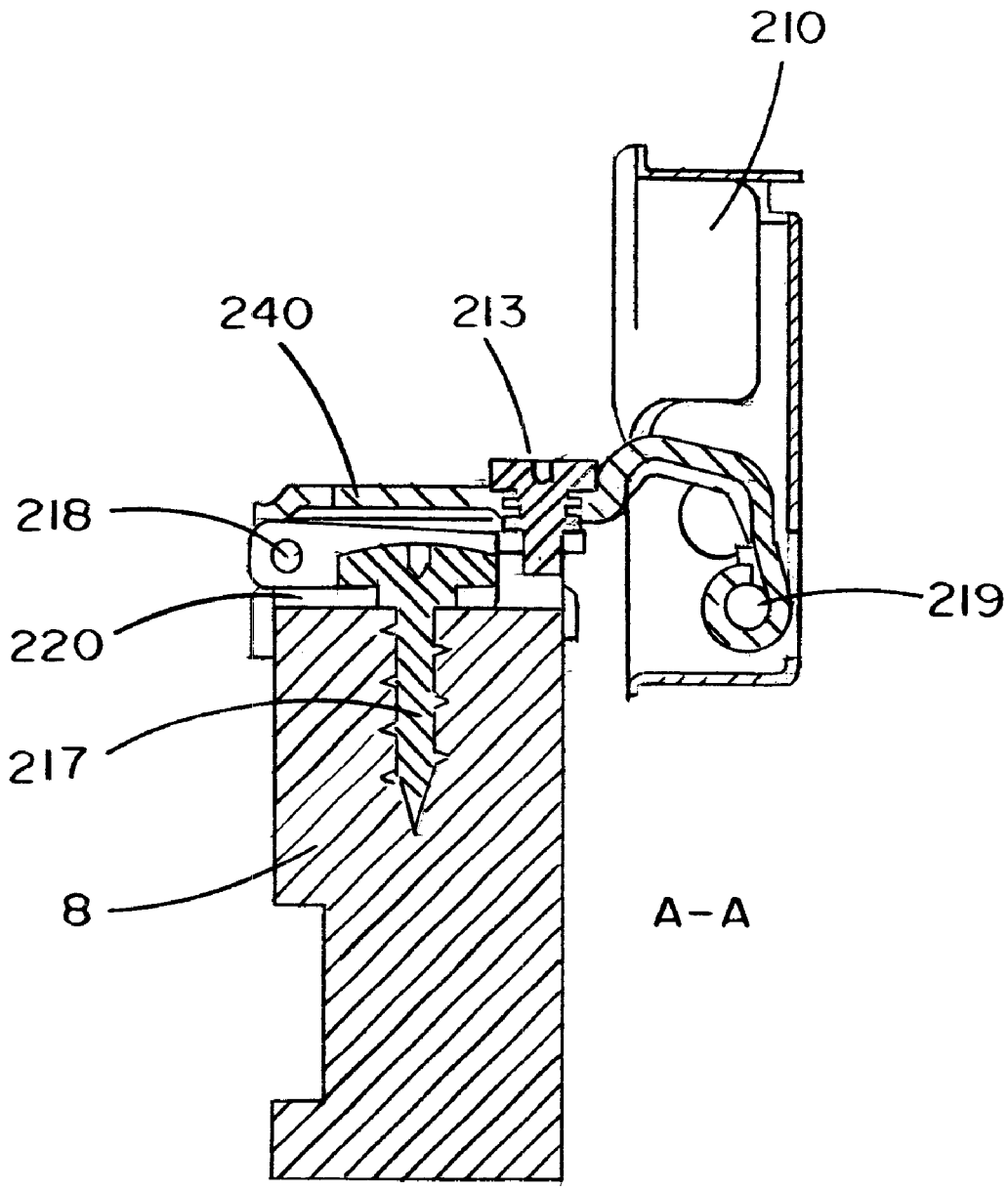
FIG. 8 is a side view of the adjustable hinge shown in FIGS. 5–7.

Referring now to FIGS. 5–8, there is shown various views of one embodiment of a two-dimensionally adjustable hinge 200 of the present invention having a two-piece hinge arm construction. FIG. 5 shows a top perspective view of hinge 200 in an open position, and FIG. 8 shows a side view of hinge 200 in a closed position. The solid lines of FIG. 7 show a top view of hinge 200 in a closed position, and the dotted lines of FIG. 7 show a top view of hinge 200 in an open position. FIG. 6 shows an exploded view of hinge 200 so that all the individual parts of hinge 200 can be more readily seen and understood.

Hinge 200 comprises a hinge cup 210, a top hinge arm segment 240, and a base hinge arm segment 220. Hinge cup 210 is mountable flush in a bore hole in the back of a door with fastening screws 217 in a known manner, and includes a spring 216 so as to facilitate automatic closing of a door once the hinge has been partially closed. Base hinge arm segment 220 is adapted to be affixed to a door frame 8.

Top hinge arm segment 240 has a center hole 241 and an elongated aperture 242 with one end open to the center hole 241. Base hinge arm segment 220 has an elongated center hole 222 and a circular aperture 226.

Top hinge arm segment 240 has an arm end pivotably attached to hinge cup 210 on a pivot axis via hinge pin 219. Top hinge arm segment 240 is also pivotably attached to base hinge arm segment 220 on a pivot axis via hinge pin 218 fastened through top hinge arm segment 240 and base hinge arm segment 220. Top hinge arm segment 240 is adjustably connected to base hinge arm segment 220 via adjustment screw 213. Adjustment screw 213 cooperates with the open-ended elongated aperture 242 in top hinge arm segment 240 and the circular aperture 226 in base hinge arm segment 220 to allow horizontally arcing adjustments to be made (i.e., side to side adjustments).

Only two-dimensional adjustments can be made with hinge 200. First, the elongated center hole 222 in base hinge arm segment 220 accepts a fastening screw 217, thereby attaching the base hinge arm segment 220 of hinge arm portion 215 to frame 8 while also allowing vertical up and down adjustments to be made easily so that the desired spacing of the door from the top and bottom of the cabinet door opening can be adjusted. Second, when adjustment screw 213 is turned, base hinge arm segment 220 moves relative to top hinge arm segment 240 in a horizontally arcing direction, thereby allowing side-to-side adjustments to be made so that the desired spacing of the doors from the opposite sides of the cabinet door openings can be adjusted. Since there is no intermediate hinge arm segment and no cam or eccentric screw in this embodiment, no horizontal in and out adjustments can be made, so the desired alignment of the front face of the door with the front of the cabinet cannot be adjusted.

Figure 9:
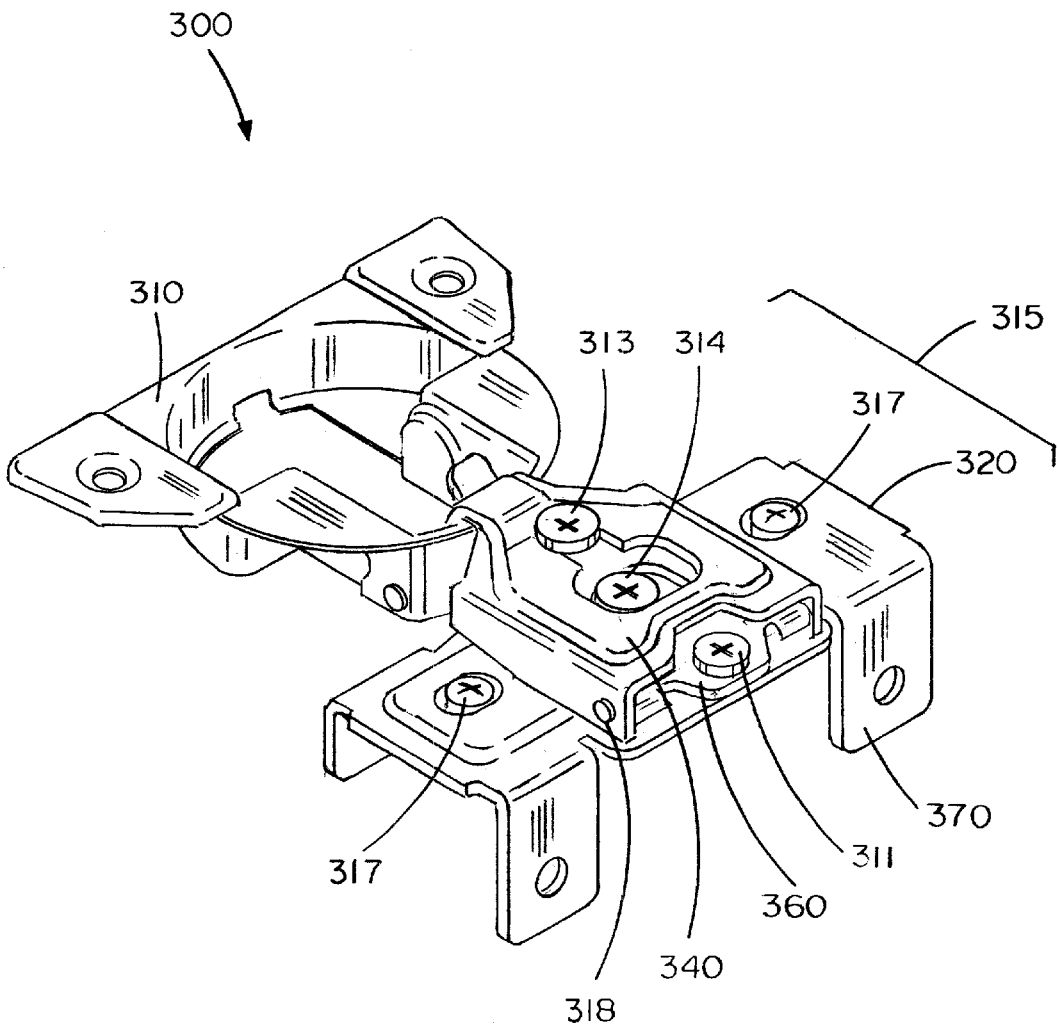
FIG. 9 is a top perspective view of another embodiment of a three-dimensionally adjustable hinge of the present invention having a four-piece hinge arm construction.
Figure 10:
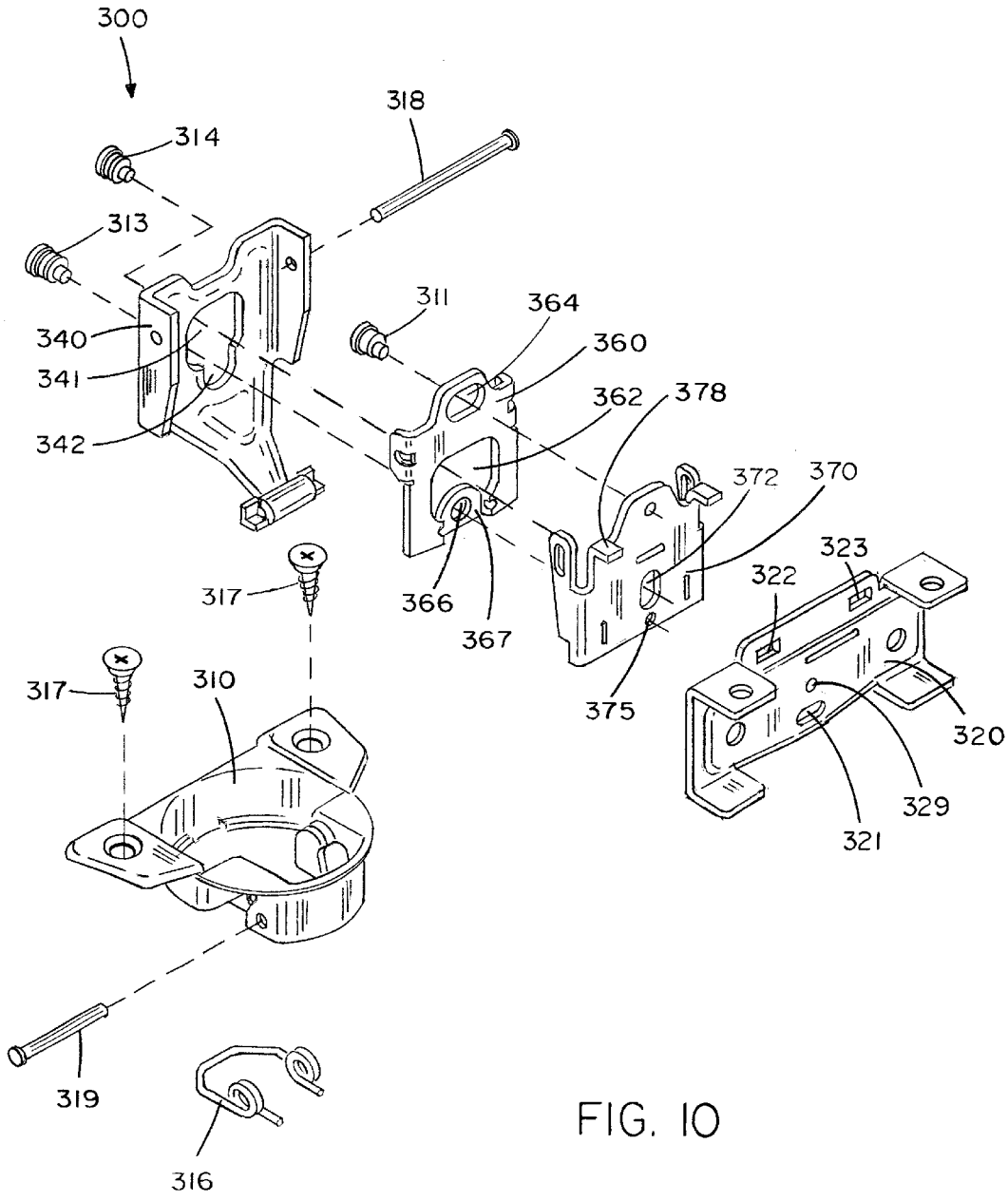
FIG. 10 is an exploded view of the adjustable hinge shown in FIG. 9.
Figure 11:
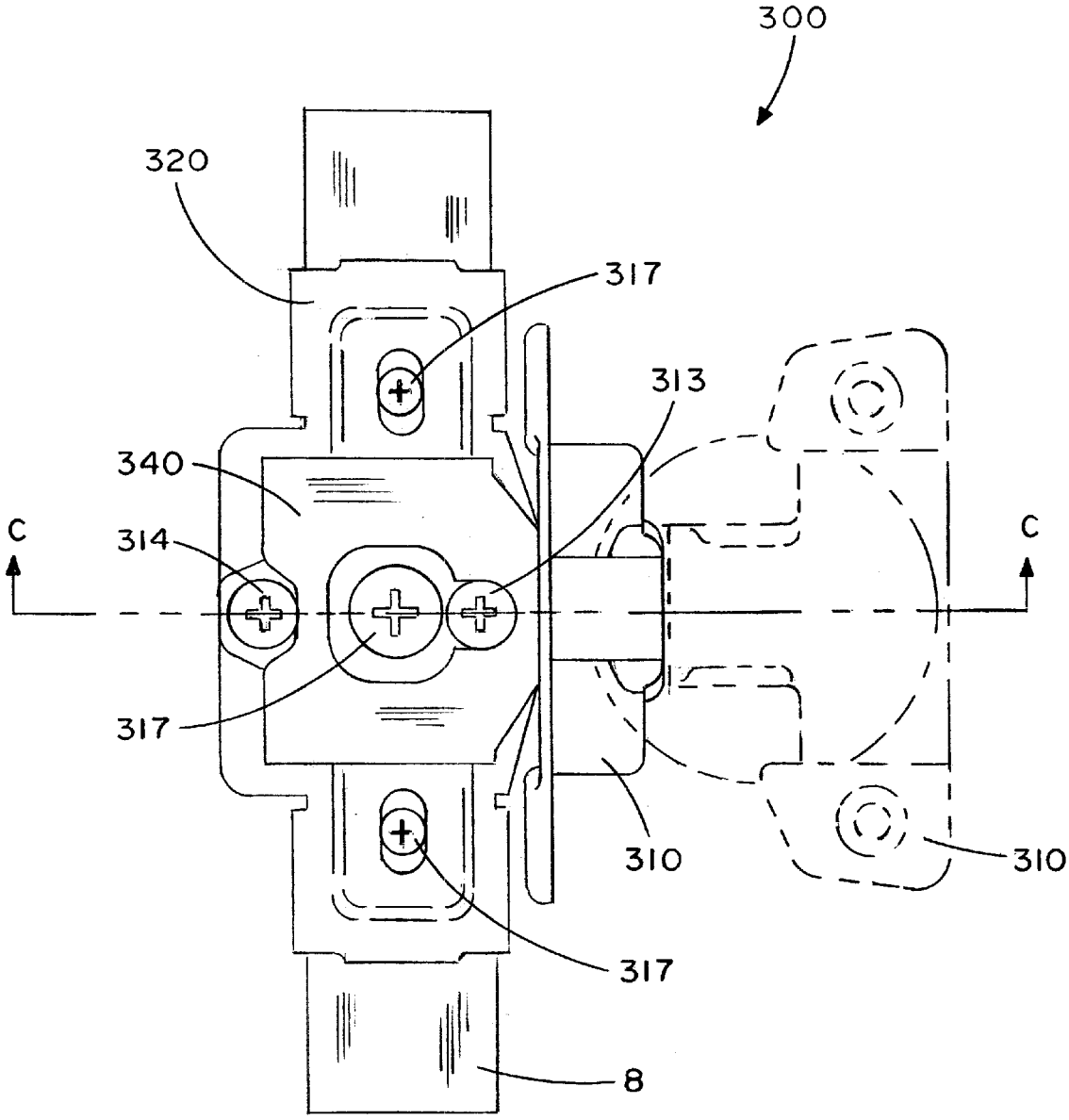
FIG. 11 is a top view of the adjustable hinge shown in FIGS. 9 and 10.
Figure 12:
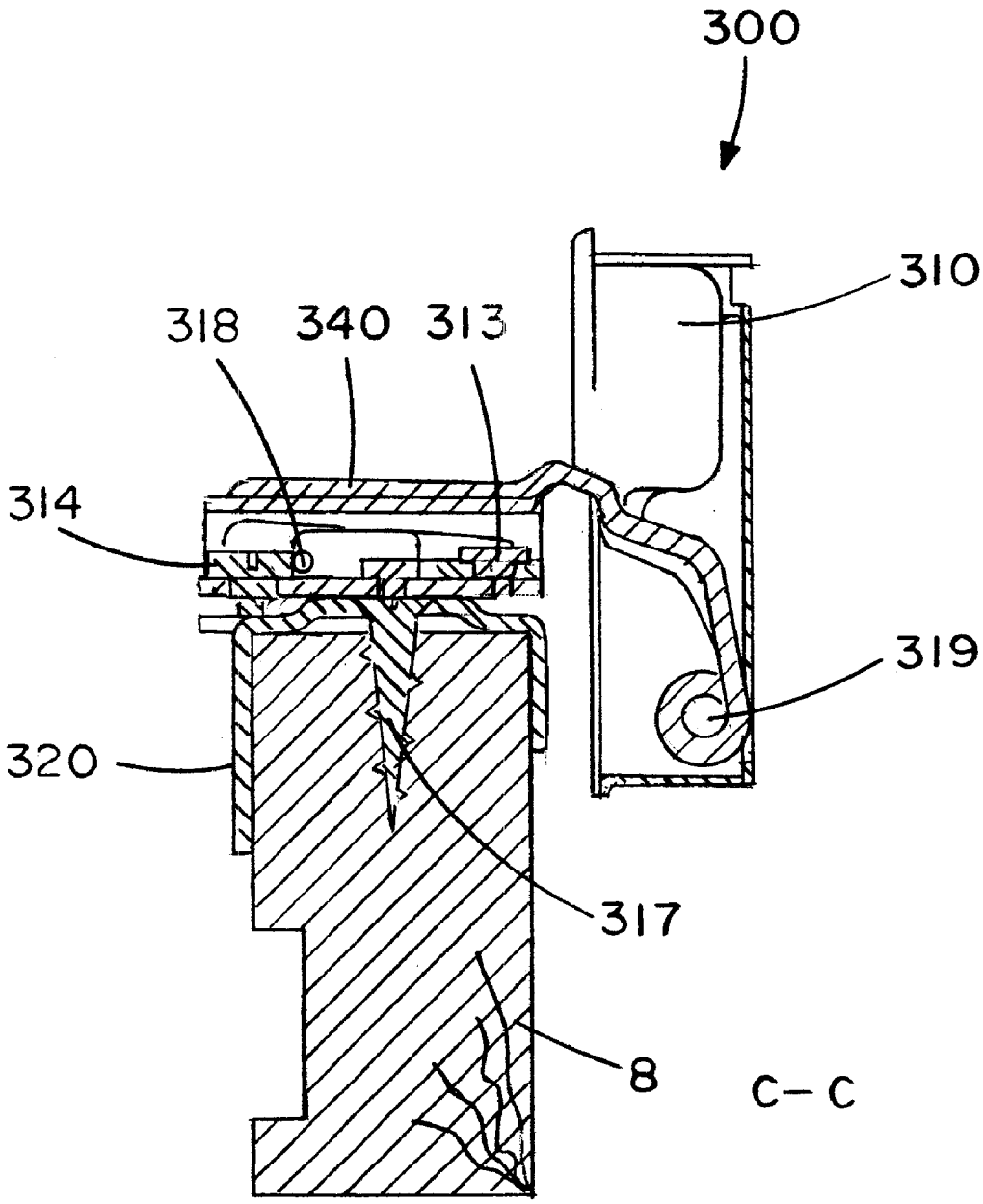
FIG. 12 is a side view of the adjustable hinge shown in FIGS. 9–11.

Referring now to FIGS. 9–12, there is shown various views of one embodiment of a three-dimensionally adjustable hinge 300 of the present invention having a four-piece hinge arm construction. FIG. 9 shows a top perspective view of hinge 300 in an open position, and FIG. 12 shows a side view of hinge 300 in a closed position. The solid lines of FIG. 11 show a top view of hinge 300 in a closed position, and the dotted lines of FIG. 11 show a top view of hinge 300 in an open position. FIG. 10 shows an exploded view of hinge 300 so that all the individual parts of hinge 300 can be more readily seen and understood.

Hinge 300 comprises a hinge cup 310, a top hinge arm segment 340, a top intermediate hinge arm segment 360, a bottom intermediate hinge arm segment 370, and a base hinge arm segment 320. Hinge cup 310 is mountable flush in a bore hole in the back of a door with fastening screws 317 in a known manner, and includes a spring 316 so as to facilitate automatic closing of a door once the hinge has been partially closed. Base hinge arm segment 320 is adapted to be affixed to a door frame 8. In hinge 300, base hinge arm segment 320 is fixedly-attached to frame 8, therefore, vertical up and down adjustments are not made via a fastening screw 317 and base hinge arm segment 320 as in the previous embodiments described above.

Top hinge arm segment 340 has a center hole 341 and an elongated aperture 342 with one end open to the center hole 341. Top intermediate hinge arm segment 360 has a center hole 362, an elongated aperture 364 and a circular aperture 366. Bottom intermediate hinge arm segment 370 has an elongated center hole 372, two circular apertures 376, 377, and a pair of bent projections 378. Base hinge arm segment 320 has three elongated slots 321, 322, 323, and a circular aperture 329.

Base hinge arm segment 320 is fixedly attached to frame 8 via two fastening screws 317. Top hinge arm segment 340 has an arm end pivotably attached to hinge cup 310 on a pivot axis via hinge pin 319. Top hinge arm segment 340 is also pivotably attached to bottom intermediate hinge arm segment 370 on a pivot axis via hinge pin 318 fastened through top hinge arm segment 340 and bottom intermediate hinge arm segment 370, and sometimes also through top intermediate hinge arm segment 360. Bottom intermediate hinge arm segment 370 is slideably connected to base hinge arm segment 320 via a pair of bent projections 378 on the bottom intermediate hinge arm segment 370 that are designed to be received into two of the elongated slots 322, 323 in base hinge arm segment 320. Bottom intermediate hinge arm segment 370 is also slideably connected to base hinge arm segment 320 with a center cam or eccentric screw 314 via the elongated aperture 372 in the bottom intermediate hinge arm segment 370 and the circular aperture 329 in the base hinge arm segment 320. Top intermediate hinge arm segment 360 is also pivotably in communication with top hinge arm segment 340. Finally, top hinge arm segment 340 is adjustably connected to top intermediate hinge arm segment 360 via adjustment screw 313. Adjustment screw 313 cooperates with the open-ended elongated aperture 342 in top hinge arm segment 340 and the circular aperture 366 in top intermediate hinge arm segment 360 to allow horizontally arcing adjustments to be made (i.e., side to side adjustments).

Bottom intermediate hinge arm segment 370 may also have a projection 375 (not shown) on the bottom side of the circular aperture 376 that is capable of being received into the elongated slot 321 in base hinge arm segment 320. This projection 375 may be in the form of a rivet that has a flanged distal end, and the elongated slot 321 in the base hinge arm segment 320 may be beveled to accommodate the flanged distal end of rivet 375. Rivet 375 moving vertically within elongated slot 321 helps prevent horizontal movement between base hinge arm segment 320 and bottom intermediate hinge arm segment 370.

Three-dimensional adjustments can be made with hinge 300. First, when center cam screw 314 is turned, bottom intermediate hinge arm segment 370 moves relative to base hinge arm segment 320 in a vertical direction, thereby allowing up and down adjustments to be made so that the desired spacing of the door from the top and bottom of the cabinet door opening can be adjusted. Second, when adjustment screw 313 is turned, top intermediate hinge arm segment 360 moves relative to top hinge arm segment 340 in a horizontally arcing direction, thereby allowing side-to-side adjustments to be made so that the desired spacing of the doors from the opposite sides of the cabinet door openings can be adjusted. Third, when second cam screw 311 is turned, top intermediate hinge arm segment 360 moves relative to bottom intermediate hinge arm segment 370 in a horizontal in and out direction so that the desired alignment of the front face of the door with the front of the cabinet can be adjusted.

The adjustment screws 113, 213, 313 used in this invention may comprise a threaded portion proximate the head of the screw, and an unthreaded portion at the other end of the screw. The unthreaded portion engages an unthreaded circular aperture (i.e., circular aperture 136, 226 or 366) in one of the hinge arm segments. The threaded portion then engages the open-ended elongated aperture 142, 242 or 342 in the top hinge arm segment.

In embodiments of the present invention, the open-ended elongated apertures 142, 242, 342 have no threads, thereby saving the secondary operation of threading those openings. Instead of threading those apertures 142, 242, 342, one side of the aperture may be displaced horizontally in front of the other so as to receive and match the pitch of the threads on the adjustment screw 113, 213, 313. The horizontal displacement between the sides of the elongated apertures 142, 242, 342 are preferably slightly greater than the horizontal distance between the valleys on the opposite sides of the adjustment screw threads, thereby creating tension to hold the adjustment screw 113, 213, 313 in position. Apertures 142, 242, 342 are purposely elongated so as to allow the hinge arm portion 115, 215, 315 of the hinges 100, 200, 300 to pivot in an arc as the respective adjustment screw 113, 213, 313 is turned.

A hinge arm segment may further comprise a raised portion 137, 227, 367 having a circular aperture 136, 226, 366 for contacting and stabilizing the adjustment screw 113, 213, 313 after it passes through the open-ended elongated aperture 142, 242, 342 in the top hinge arm segment 140, 240, 340.

In some embodiments, at least one of the hinge arm segments further comprises opposing lateral edges from which depend a pair of opposing side members that define a channel for receiving another hinge arm segment. The opposing lateral edges are preferably spaced from one another a distance that defines a width of the hinge arm segment. The width of each hinge arm segment is determined so that the various hinge arm segments can nest together. For example, in hinge 100, the top hinge arm segment 140 and the base hinge arm segment 120 may both have opposing side members 147, 127 that define the width of the respective segments, with the width of the base hinge arm segment 120 being slightly less than the width of the top hinge arm segment 140 so that the opposing side members 127 of the base hinge arm segment 120 nest within the opposing side members 147 of the top hinge arm segment 140. Alternatively, all three of these hinge arm segments 140, 130, 120 could have opposing side members defining the width of each respective segment, with the widths of the segments varying so that the opposing side members of all three hinge arm segments nest together one within another. Other embodiments of the hinges of the present invention may be similarly designed to include such opposing side members.

The three-dimensional adjustment aspect of some embodiments of the adjustable hinge of the present invention not only allows adjustment of the position of a cabinet door vertically up-and-down relative to the supporting cabinet (i.e., up and down in direction X with the door in the closed position to achieve desired spacing of the door from the top and bottom of the cabinet door opening) and horizontally in-and-out relative to the supporting cabinet (i.e., to and fro in direction Y with the door in the closed position to achieve desired alignment of the front face of the door with the front of the cabinet), but also enables adjustment of the cabinet door horizontally from side-to-side relative to the supporting cabinet (i.e., from side to side in direction Z with the door in the closed position to achieve desired spacing of the door from the opposite sides of the cabinet door opening). Direction Y comes straight out of the paper in FIG. 1.

Embodiments of the adjustable hinges of the present invention may also include, for example, a base hinge arm segment 120, 220 having an elongated center hole 122, 222 that extends parallel to the pivot axis of the hinge 100, 200, respectively. The intermediate hinge arm segments 130 (if there are any) preferably have a center hole 132 that is somewhat rectangular and larger than the center hole 122 of the base hinge arm segment 120. The top hinge arm segment 140, 240 preferably has a center hole 141, 241 that is also somewhat rectangular and larger than the center hole 122, 222 of the base plate 120, 220 and at least as large as the center hole 132 of any intermediate plate 130. In embodiments, the base hinge arm segments 120, 220 are adapted to be fastened on the furniture article frame 8 by at least one mounting screw 117, 217 inserted, preferably, through the elongated center hole 122, 222 of the base hinge arm segment 120, 220. In embodiments, the elongated center hole 122, 222 in the base hinge arm segment is adapted to allow the base hinge arm segment 120, 220 to be displaced relative to the furniture article frame 8 in a vertical direction (when the hinge is in its mounted and closed position) parallel to the pivot axis of the hinge by loosening the single mounting screw 117, 217. In other embodiments, the base hinge arm segment 320 may be fastened on the furniture article frame 8 with two mounting screws 317, with neither mounting screw being secured through the center holes of any hinge arm segment, as shown in FIG. 10.

The cam or eccentric screw 114, 314, 311 is generally mounted in a hinge arm segment by means of a projection, and then extends through an elongated opening in another hinge arm segment to hold the two hinge arm segments together. The cam or eccentric screw is rotatable about a central axis thereof, and the projection extends parallel to the central axis of the cam or eccentric screw and is radially offset therefrom.

In hinge 100, the cam or eccentric screw 114 is mounted in the circular aperture 124 in base hinge arm segment 120 by means of a projection, and the cam or eccentric screw 114 then extends through the elongated slot 134 in the intermediate hinge arm segment 130. The elongated slot 134 in the intermediate hinge arm segment 130 extends parallel to the pivot axis of the hinge 100. Turning this cam or eccentric screw 114 causes the base hinge arm segment 120 to be displaced on the intermediate hinge arm segment 130 in a direction perpendicular to the pivot axis of hinge 100.

In hinge 300, the center cam or eccentric screw 314 is mounted in the base hinge arm segment 320 by means of a projection in circular aperture 329, and the center cam or eccentric screw 314 then extends through the elongated center hole 372 in the bottom intermediate hinge arm segment 370. The elongated center hole 372 in the bottom intermediate hinge arm segment 370 extends perpendicular to the pivot axis of the hinge 300. The second cam or eccentric screw 311 in hinge 300 is mounted in the bottom intermediate hinge arm segment 370 by means of a projection in circular aperture 377, and the cam or eccentric screw 311 then extends through the elongated hole 364 in the top intermediate hinge arm segment 360. The elongated center hole 364 in this top intermediate hinge arm segment 360 extends parallel to the pivot axis of hinge 300, as do the elongated apertures 321, 322, 323 in this base hinge arm segment 320. Turning this center cam or eccentric screw 314 causes the bottom intermediate hinge arm segment 370 to be displaced on the base hinge arm segment 320 in a direction parallel to the pivot axis of hinge 300 (i.e., up and down vertically). Turning this second cam or eccentric screw 311 causes the top intermediate hinge arm segment 360 to be displaced on the bottom intermediate hinge arm segment 370 in a direction perpendicular to the pivot axis of hinge 300 (i.e., horizontally in and out).

The base hinge arm segment 120 of the hinge component 100 for embodiments of the present invention has a pair of back legs 123 that rest against a back side of the face of frame 8 and a pair of front legs 125 that rest against a front side of the face of frame 8 in a mounted condition of the base hinge arm segment 120. Legs 123, 125 ensure that the hinge arm portion 115 of the hinge 100 remains stable and in position once the doors are hung from the hinge 100. The base hinge arm segments 220, 320 of the other embodiments described herein may also be configured to included legs like legs 123, 125.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of various embodiments of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a furniture article frame for movement between open and closed positions of the door relative to the furniture article frame, comprising:

a hinge cup member adapted to be affixed to the door;

a top hinge arm segment having a top center hole and a top elongated aperture with one end open to the top center hole;

an intermediate hinge arm segment having a intermediate center hole, an intermediate circular aperture and an intermediate elongated aperture;

a base hinge arm segment having a base elongated center hole and a base circular aperture and being adapted to be fastened on the furniture article frame by at least one mounting screw inserted through the base elongated center hole;

an adjustment screw; and a cam screw, wherein the top hinge arm segment is pivotably connected to the hinge cup member on a first pivot axis, wherein the top hinge arm segment is pivotably connected to the base hinge arm segment on a second pivot axis, wherein the intermediate hinge arm segment is pivotably in communication with the top hinge arm segment, wherein the base hinge arm segment is slideably connected to the intermediate hinge arm segment with the cam screw via the intermediate elongated aperture in the intermediate hinge arm segment and the base circular aperture in the base hinge arm segment, wherein the intermediate hinge arm segment is adjustably connected to the top hinge arm segment by the adjustment screw cooperating with the top elongated aperture in the top hinge arm segment and the intermediate circular aperture in the intermediate hinge arm segment, wherein the base elongated center hole allows vertical adjustments to be made in a direction parallel to the first pivot axis of the hinge, wherein turning the adjustment screw causes the intermediate hinge arm segment to move relative to the top hinge arm segment in a horizontally arcing direction perpendicular to the first pivot axis of the hinge, and wherein turning the cam screw causes the base hinge arm segment to move relative to the intermediate hinge arm segment in a horizontal direction perpendicular to the first pivot axis of the hinge.

2. The hinge of claim 1, wherein the base elongated center hole is elongated in a direction parallel to the first pivot axis of the hinge and is adapted to allow the base hinge arm segment to be displaced relative to the furniture article frame in a direction parallel to the first pivot axis of the hinge by loosening the mounting screw.

3. The hinge of claim 1, wherein the cam screw is rotatable about a central axis thereof, wherein a projection extends from one end of the cam screw parallel to the central axis thereof, and wherein the projection is radially offset from the central axis of the cam screw.

4. The hinge of claim 1, wherein the adjustment screw further comprises an unthreaded portion proximate a head of the adjustment screw that engages an unthreaded aperture.

5. The hinge of claim 4, wherein the unthreaded aperture is the intermediate circular aperture in the intermediate hinge arm segment.

6. The hinge of claim 1, wherein the top elongated aperture in the top hinge arm segment has no threads.

7. The hinge of claim 6, wherein one side of the top elongated aperture is displaced horizontally relative to the other side of the top elongated aperture so as to receive and match the pitch of threads on the adjustment screw.

8. The hinge of claim 7, wherein the horizontal displacement between the sides of the top elongated aperture is slightly larger than the distance between valleys on opposite sides of the threads on the adjustment screw so that tension is created to hold the adjustment screw in position.

9. The hinge of claim 1, wherein at least one of the top hinge arm segment, the intermediate hinge arm segment and base hinge arm segment further comprises opposing lateral edges and a pair of opposing side members depending therefrom to define a channel for receiving the another hinge arm segment.

10. The hinge of claim 1, wherein the intermediate hinge arm segment further comprises a raised portion that contacts and stabilizes the adjustment screw.

11. The hinge of claim 1, wherein the base hinge arm segment further comprises a pair of back legs that rest against a back side of the furniture article frame and a pair of front legs that rest against a front side of the furniture article frame to ensure that the base hinge arm segment remains stable and in position once the door is attached to the hinge.

12. A hinge for mounting a door on a furniture article frame for movement between open and closed positions of the door relative to the furniture article frame, comprising:

a hinge cup member adapted to be affixed to the door;

a top hinge arm segment having a top center hole and a top elongated aperture with one end open to the top center hole;

a base hinge arm segment having a base elongated center hole and a base circular aperture and being adapted to be fastened on the furniture article frame by at least one mounting screw inserted through the base elongated center hole; and an adjustment screw, wherein the top hinge arm segment is pivotably connected to the hinge cup member on a first pivot axis, wherein the top hinge arm segment is pivotably connected to the base hinge arm segment on a second pivot axis, wherein the base hinge arm segment is adjustably connected to the top hinge arm segment by the adjustment screw cooperating with the top elongated aperture in the top hinge arm segment and the base circular aperture in the base hinge arm segment, wherein the base elongated center hole allows vertical adjustments to be made in a direction parallel to the first pivot axis of the hinge, and wherein turning the adjustment screw causes the base hinge arm segment to move relative to the top hinge arm segment in a horizontally arcing direction perpendicular to the first pivot axis of the hinge.

13. The hinge of claim 12, wherein the base elongated center hole is elongated in a direction parallel to the first pivot axis of the hinge and is adapted to allow the base hinge arm segment to be displaced relative to the furniture article frame in a direction parallel to the first pivot axis of the hinge by loosening the mounting screw.

14. The hinge of claim 12, wherein the adjustment screw further comprises an unthreaded portion proximate a head of the adjustment screw that engages an unthreaded aperture.

15. The hinge of claim 14, wherein the unthreaded aperture is the base circular aperture in the base hinge arm segment.

16. The hinge of claim 12, wherein the top elongated aperture in the top hinge arm segment has no threads.

17. The hinge of claim 16, wherein one side of the top elongated aperture is displaced horizontally relative to the other side of the top elongated aperture so as to receive and match the pitch of threads on the adjustment screw.

18. The hinge of claim 17, wherein the horizontal displacement between the sides of the top elongated aperture is slightly larger than the distance between valleys on opposite sides of the threads on the adjustment screw so that tension is created to hold the adjustment screw in position.

19. The hinge of claim 12, wherein at least one of the top hinge arm segment and base hinge arm segment further comprises opposing lateral edges and a pair of opposing side members depending therefrom to define a channel for receiving the another hinge arm segment.

20. The hinge of claim 12, wherein the base hinge arm segment further comprises a raised portion that contacts and stabilizes the adjustment screw.

21. The hinge of claim 12, wherein the base hinge arm segment further comprises a pair of back legs that rest against a back side of the furniture article frame and a pair of front legs that rest against a front side of the furniture article frame to ensure that the base hinge arm segment remains stable and in position once the door is attached to the hinge.

22. A hinge for mounting a door on a furniture article frame for movement between open and closed positions of the door relative to the furniture article frame, comprising:

a hinge cup member adapted to be affixed to the door;

a top hinge arm segment having a top center hole and a top elongated aperture with one end open to the top center hole;

a top intermediate hinge arm segment having a top intermediate center hole, a top intermediate circular aperture and a top intermediate elongated aperture;

a bottom intermediate hinge arm segment having a bottom intermediate elongated center hole, two bottom intermediate circular apertures and a pair of bent projections;

a base hinge arm segment having three base elongated slots and a base circular aperture and being adapted to be fixedly-fastened on the furniture article frame by at least one mounting screw;

an adjustment screw;

a center cam screw; and a second cam screw, wherein the top hinge arm segment is pivotably connected to the hinge cup member on a first pivot axis, wherein the top hinge arm segment is pivotably connected to the bottom intermediate hinge arm segment on a second pivot axis, wherein the top intermediate hinge arm segment is pivotably in communication with the top hinge arm segment, wherein the bottom intermediate hinge arm segment is slideably connected to the base hinge arm segment via the pair of bent projections on the bottom intermediate hinge arm segment that are designed to be received into two of the three base elongated slots in the base hinge arm segment, wherein the bottom intermediate hinge arm segment is slideably connected to the base hinge arm segment with the center cam screw via the bottom intermediate elongated aperture in the bottom intermediate hinge arm segment and the base circular aperture in the base hinge arm segment, wherein the top intermediate hinge arm segment is adjustably connected to the top hinge arm segment by the adjustment screw cooperating with the top elongated aperture in the top hinge arm segment and the top intermediate circular aperture in the top intermediate hinge arm segment, wherein the top intermediate hinge arm segment is slideably connected to the bottom intermediate hinge arm segment with the second cam screw via the top intermediate elongated aperture in the top intermediate hinge arm segment and one of the bottom intermediate circular apertures in the bottom intermediate hinge arm segment, wherein turning the adjustment screw causes the top intermediate hinge arm segment to move relative to the top hinge arm segment in a horizontally arcing direction perpendicular to the first pivot axis of the hinge, wherein turning the center cam screw causes the bottom intermediate hinge arm segment to move relative to the base hinge arm segment in a vertical direction parallel to the first pivot axis of the hinge, and wherein turning the second cam screw causes the top intermediate hinge arm segment to move relative to the bottom intermediate hinge arm segment in a horizontal direction perpendicular to the first pivot axis of the hinge.

23. The hinge of claim 22, wherein the bottom intermediate elongated center hole is elongated in a direction perpendicular to the first pivot axis of the hinge and is adapted to allow the bottom intermediate hinge arm segment to be displaced relative to the base hinge arm segment in a direction parallel to the first pivot axis of the hinge by turning the center cam screw.

24. The hinge of claim 22, wherein the cam screw is rotatable about a central axis thereof, wherein a projection extends from one end of the cam screw parallel to the central axis thereof, and wherein the projection is radially offset from the central axis of the cam screw.

25. The hinge of claim 22, wherein the adjustment screw further comprises an unthreaded portion proximate a head of the adjustment screw that engages an unthreaded aperture.

26. The hinge of claim 25, wherein the unthreaded aperture is the top intermediate circular aperture in the top intermediate hinge arm segment.

27. The hinge of claim 22, wherein the top elongated aperture in the top hinge arm segment has no threads.

28. The hinge of claim 27, wherein one side of the top elongated aperture is displaced horizontally relative to the other side of the top elongated aperture so as to receive and match the pitch of threads on the adjustment screw.

29. The binge of claim 28, wherein the horizontal displacement between the sides of the top elongated aperture is slightly larger than the distance between valleys on opposite sides of the threads on the adjustment screw so that tension is created to hold the adjustment screw in position.

30. The hinge of claim 22, wherein at least one of the top hinge arm segment, the top intermediate hinge arm segment, the bottom intermediate hinge arm segment and base hinge arm segment further comprises opposing lateral edges and a pair of opposing side members depending therefrom to define a channel for receiving the another hinge arm segment.

31. The hinge of claim 22, wherein the top intermediate hinge arm segment further comprises a raised portion that contacts and stabilizes the adjustment screw.

32. The hinge of claim 22, wherein the base hinge arm segment further comprises a pair of back legs that rest against a back side of the furniture article frame and a pair of front legs that rest against a front side of the furniture article frame to ensure that the base hinge arm segment remains stable and in position once the door is attached to the hinge.

* * * * *